US008464445B2

(12) United States Patent
Jiang et al.

(10) Patent No.: US 8,464,445 B2
(45) Date of Patent: Jun. 18, 2013

(54) STEAM IRONING DEVICE HAVING HEATING MEANS, PUMP, AND CONTROL CIRCUIT TO CONTROL RATIO OF FLUID FLOW RATE OF PUMP TO POWER OF HEATING MEANS

(75) Inventors: Yong Jiang, Singapore (SG); Bas Jeroen Oosterman, Amersfoort (NL); Boon Khian Ching, Snoqualmie, WA (US); Kai Heng Kwok, Singapore (SG); Mohankumar Valiyambath Krishnan, Singapore (SG)

(73) Assignee: Koninklijke Philips Electronics, N.V., Eindhoven (NL)

( * ) Notice: Subject to any disclaimer, the term of this patent is extended or adjusted under 35 U.S.C. 154(b) by 1278 days.

(21) Appl. No.: 10/582,908

(22) PCT Filed: Dec. 10, 2004

(86) PCT No.: PCT/IB2004/052758

§ 371 (c)(1),
(2), (4) Date: Jun. 14, 2006

(87) PCT Pub. No.: WO2005/059232

PCT Pub. Date: Jun. 30, 2005

(65) Prior Publication Data

US 2007/0102414 A1 May 10, 2007

(30) Foreign Application Priority Data

Dec. 16, 2003 (EP) ..... 03104734

(51) Int. Cl.
*D06F 75/26* (2006.01)

(52) U.S. Cl.
USPC ..... 38/77.7; 38/77.83; 38/93; 219/245; 219/251; 219/254; 219/255; 219/258

(58) Field of Classification Search
USPC ..... 219/245, 254, 255, 257, 258; 38/77.83, 38/96, 77.8, 77.5, 77.1, 77.7; 392/342, 399, 392/403, 405
See application file for complete search history.

(56) References Cited

U.S. PATENT DOCUMENTS

| | | | | |
|---|---|---|---|---|
| 2,615,265 | A * | 10/1952 | Maykemper | 38/77.8 |
| 5,042,179 | A * | 8/1991 | van der Meer | 38/77.83 |
| 5,536,375 | A * | 7/1996 | Vogelman | 203/2 |
| 5,642,579 | A * | 7/1997 | Netten et al. | 38/77.7 |
| 5,787,614 | A * | 8/1998 | Stutzer | 38/77.1 |

(Continued)

FOREIGN PATENT DOCUMENTS

| | | |
|---|---|---|
| EP | 1 191 140 | 3/2002 |
| WO | WO 2004/085732 | 10/2004 |

*Primary Examiner* — Tu B Hoang
*Assistant Examiner* — Brian Jennison

(57) ABSTRACT

A steam ironing device includes a water supply device, a steam generator for generating steam, a heating element for heating the steam generator, at least one atomizating device, a valve provided in a flow path between the steam generator and the atomizing device, and an electric pump for delivering water from said water supply device to said steam generator. To obtain wet steam at the atomizing device, the ironing device includes a control device for controlling the power of the heating element of the steam generator, for controlling the flow rate of the pump, and for controlling the opening and closing of the valve, the valve being open if the ratio between the flow rate (g/min) of the pump and the power (W) of the heating element is in a range of 1:20 to 1:38.

8 Claims, 3 Drawing Sheets

U.S. PATENT DOCUMENTS 6,035,563 A * 3/2000 Hoefer et al. ..... 38/77.1
6,446,370 B1 * 9/2002 Ostermaier ..... 38/77.6
2006/0005437 A1 * 1/2006 Valiyambath Krishnan .. 38/77.8
2006/0213092 A1 * 9/2006 Di Leta ..... 38/77.1

* cited by examiner

STEAM IRONING DEVICE HAVING HEATING MEANS, PUMP, AND CONTROL CIRCUIT TO CONTROL RATIO OF FLUID FLOW RATE OF PUMP TO POWER OF HEATING MEANS

BACKGROUND OF THE INVENTION

1. Field of the Invention

The invention relates to a steam ironing device comprising a steam iron having a housing, a heatable soleplate at the bottom side of said housing, and at least one atomization device, said ironing device comprising a water supply device, a steam generator for generating steam, heating means for heating the steam generator, a flow path between the steam generator and the atomizing device, a valve provided in the flow path between the steam generator and the atomizing device, and an electric pump for delivering water from said water supply device to said steam generator.

2. Description of the Related Art

Such an ironing device is known from European Patent Application No. EP-A 1191140. This device is provided with a steam generator for generating hot steam. To obtain wet steam at an outlet of the atomizing device, water is inserted into the steam flow path towards the atomizing device by means of a second pump.

SUMMARY OF THE INVENTION

It is an object of the invention to provide an ironing device with simple means for obtaining wet steam at the atomizing device in a controlled manner.

According to the invention, the ironing device comprises control means for controlling the power of the heating means of the steam generator, for controlling the flow rate of the pump, and for controlling the opening and closing of said valve, said valve being open if the ratio between the flow rate of the pump and the power of the heating means is in a range of 1:20 to 1:38.

The steam generator according to the invention generates wet steam. The wetness of the steam in the steam generator, i.e. the ratio between the amount of water and the amount of steam, is determined by the control means and depends on the ratio between the flow rate of the pump and the power of the heating means. The desired water-to-steam ratio can be obtained by adjusting both the power of the heating element of the steam generator and the flow rate of the pump. However, it is also possible to keep the power of the heating element at a fixed value and only to adjust the flow rate of the pump, or vice versa, to obtain the desired ratio. If the ratio between the flow rate of the pump and the power of the heating means is within the claimed range, moistening of fabrics is very effective.

Water-to-steam ratio is to be understood as follows:

It is physically known how much heat energy is needed for converting a certain amount of water completely into steam. So, if the flow rate of the pump is X g/min, the power of the heating element for the steam generator should be Z watts to convert said water completely into steam. If the power of the heating element is kept at the same level and more water is introduced into the steam generator, for example the flow rate is X+Y g/min, the amount of water according to Y g/min will not be converted into steam but will remain as water in a rather undefined shape, mostly big droplets. In that case the water to steam ratio is X:Y. For example, the power of the heating element of the steam generator is 1350 W to convert 30 g/min water fully into steam. In general, for a complete conversion of water into steam the power is proportional to the water flow rate. If the flow rate is increased to 50 g/min, 20 g/min of water will not be converted into steam but will remain water. The water-to-steam ratio is then 1:1.5 (20:30). This means that the ratio between the flow rate (g/min) of the pump and the power (W) of the heating element is 1:27 (50:1350). The atomizing device causes a breakdown of the water into a fine mist with a very small particle size of the water droplets which can easy penetrate into the garment. The atomizing device has a usual nozzle which is similar to a nozzle used for obtaining a spray of water.

It is to be noted that, contrary to the iron described in EP-A 1191140, only one pump is necessary in this device to obtain the desired wet steam.

Preferably, the ratio between the flow rate of the pump and the power of the heating means is in the range of 1:23 to 1:30. Tests have shown that the particle size of the water droplets in this fine mist is in the range of 20-65 μm, which has proven to be a very effective way of penetration into the garment.

It is further preferred that said atomizing device comprises at least one nozzle provided in a front part of the housing. However, it is also possible to arrange said nozzle(s) in the tip area of the soleplate.

In a preferred embodiment of the ironing device, the soleplate is provided with at least one discharge opening which is connected to the steam generator through a second flow path in which a steam chamber is provided. In the steam chamber, the wet steam is heated up to dry or superheated steam. During ironing of the garment, wrinkles can be removed easily by means of the hot soleplate in conjunction with the dry or superheated steam.

In another embodiment of the ironing device, the soleplate is provided with at least one discharge opening which is connected to the steam generator through a second flow path between said valve and said at least one discharge opening, said valve opening the second flow path if the ratio between the flow rate of the pump and the power of the heating means is greater than 1:45. The valve is now a 3-way valve. This enables a user to select the desired mode of steam (mist steam or dry steam), and the control device controls the power of the heating means of the steam generator, the flow rate of water to the steam generator, and the position of the 3-way valve. Instead of a 3-way valve it is also possible to have a separate second flow path between the steam generator and the discharge opening(s) in the soleplate, while a second valve is provided in this second flow path.

In a further embodiment of the above described embodiment, a steam chamber may be provided in the second steam path. The steam can be heated up so as in the steam chamber to obtain a drier or even superheated steam.

BRIEF DESCRIPTION OF THE DRAWINGS

These and other aspects of the invention will be apparent from and elucidated with reference to the embodiments described hereinafter.

Throughout all embodiments, similar part of the ironing device are indicated with the same reference numerals.

DESCRIPTION OF THE PREFERRED EMBODIMENTS

Figure 1:
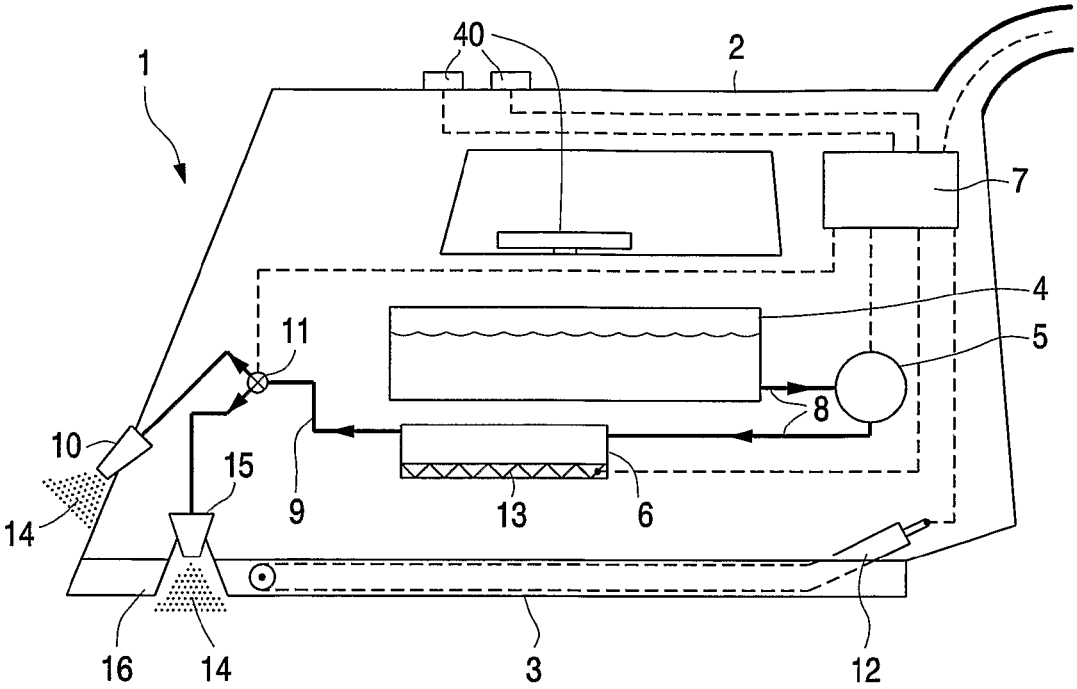
FIG. 1 is a first embodiment of an electric iron suitable only for spraying mist steam.

The steam ironing device of the first embodiment (FIG. 1) consists of a steam iron 1 having a housing 2 with a soleplate 3 at the bottom side of the housing. A water reservoir 4, an electric pump 5, a steam generator 6, and control means 7 are accommodated inside the housing. User-operable control buttons 40 are provided on the housing 2 to control several functions of the device. A water passage 8 connects the water reservoir 4 to the electric pump 5 and the electric pump to the steam generator 6. A steam passage 9 connects the steam generator 6 to an atomizing device 10 via a valve 11. The iron is further provided with a heating element 12 for heating the soleplate 3 and a heating element 13 for heating the steam generator 6.

In operation, when the iron is powered, the user can decide to perform the ironing task with the aid of mist steam. The power of the heating element 13 of the steam generator has, for example, a fixed value. The user selects the desired kind of mist steam which corresponds with a certain flow rate of the pump by means of one of the control buttons 40. The kind of mist steam may depend on the kind of garment to be ironed. For ironing jeans, for example, the amount of water in the mist steam should be greater than for ironing linen. The control means 7 trigger the pump 5 to deliver the proper flow rate. When the steam generator 6 has reached its operating temperature, the user can open the valve 11, which results in starting of the pump 5. The pump can only be started when the steam generator has reached its operating temperature. Water flows to the steam generator 6 and within a second a mixture of steam and water flows through the steam passage 9 to the atomizing device 10, where water is broken down into very fine water droplets so that a spray of mist steam 14 is ejected on the garment. The valve 11 may be a mechanically or electromechanically controlled valve.

One of more atomizing devices 10 may be provided in the front part of the housing 2. In addition or solely, an atomizing device 15 may be provided in the tip area 16 of the soleplate 3.

Figure 2:
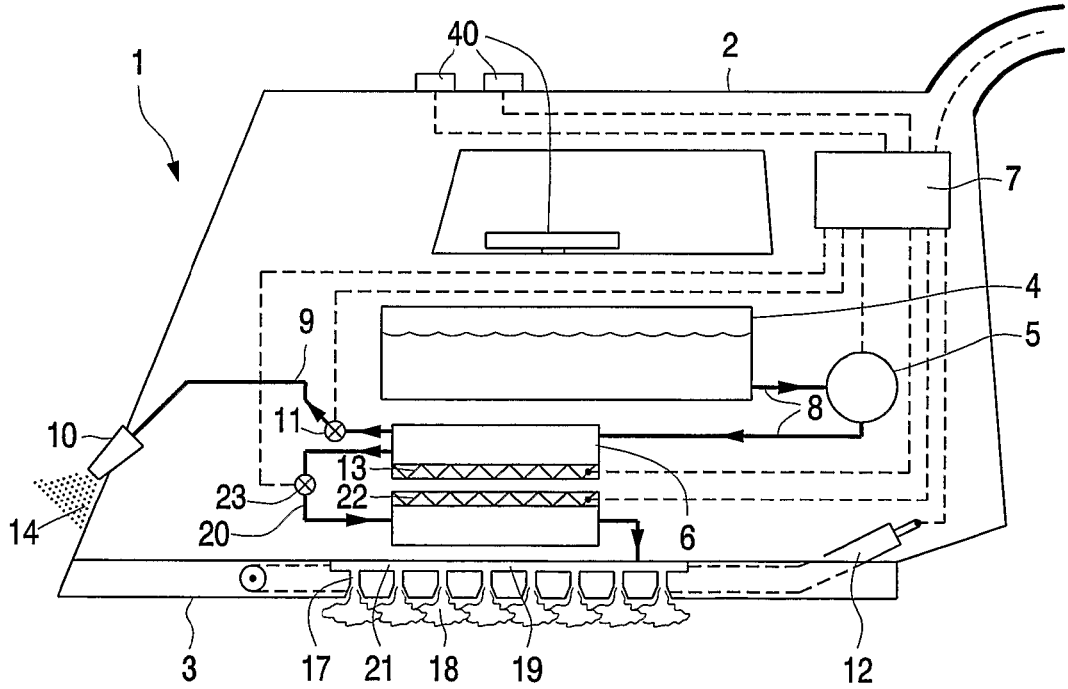
FIG. 2 is a second embodiment of an electric iron suitable for spraying mist steam and dry steam through the soleplate.

The steam ironing device of the second embodiment (FIG. 2) is an extension of the first embodiment. The soleplate 3 is provided with steam discharge openings 17 for dry or superheated steam 18. The discharge openings 17 are connected to the steam generator 6 via distribution channels 19 and a second flow path 20 in which a steam chamber (or steam generator) 21 is provided. The steam chamber is heated by a heating element 22. A second valve 23 may be additionally provided in the flow path 19 to improve the control over the steaming function.

Figure 3:
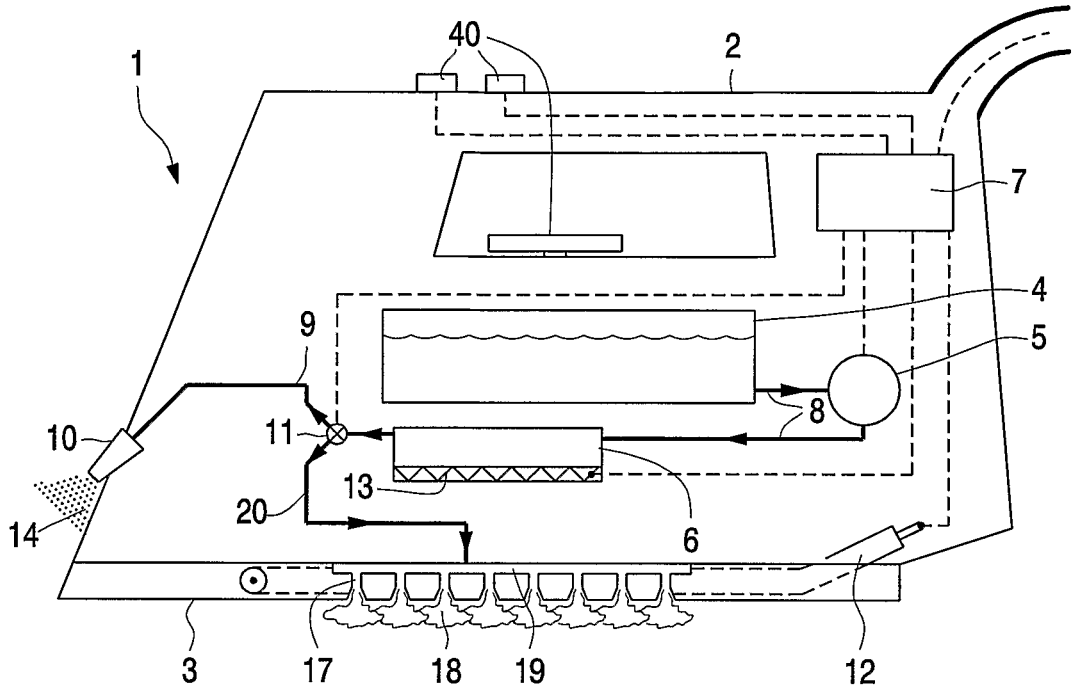
FIG. 3 is a third embodiment of an electric iron suitable for spraying mist steam and dry steam through the soleplate.
Figure 4:
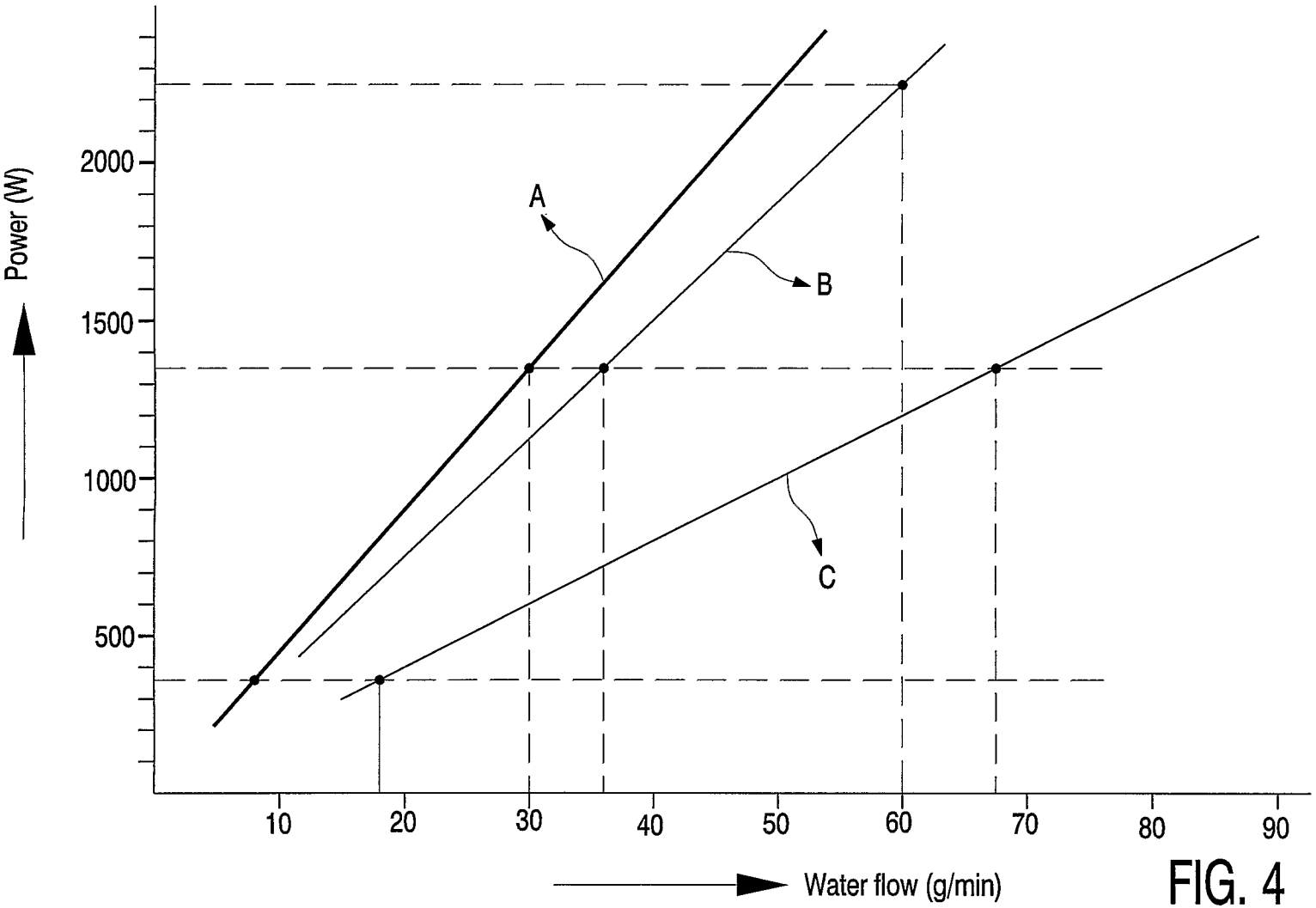
FIG. 4 is a graph showing the area of the ratio between the flow rate of the pump and the power of the heating means for the steam generator.

In the third embodiment (FIG. 3), the steam discharge openings 17 in the soleplate 3 are directly connected to the steam generator 6. The second flow path 20 connects the distribution channels 19 to the valve 11. Valve 11 is now a 3-way valve or a deviator. If the user decides to use only dry or superheated steam, the control button 40 is switched to the required position so that the ratio between the flow rate of the pump 5 and the power of the heating element 13 of the steam generator 6 is suitable for dry or even superheated steaming.

The water supply device may be a water reservoir inside the iron as described in the embodiment, but it may alternatively be a water reservoir inside a separate stand to which the iron is connected via a hose. Also, the pump may be located inside such a stand. Another possibility is that the water supply means is an automatic water source such as the water mains.

The steam generator 6 is preferably a flow heater. In a flow heater water travels a relatively long way through the heater.

FIG. 5 shows a graph with the relation between the water flow (g/min) of the pump and the power (W) of the heating element of the steam generator. Line A indicates the ratio between the water flow and the power where all water is converted into steam. The water flow/power ratio is 1:45. For example, a power of 1350 W is needed to convert a water flow of 30 g/min completely into steam. The power is proportional to the water flow. Line B corresponds to a water flow/power ratio of 1:38. For example, if the power is 1350 W and the water flow is 36 g/min, about 30 g/min is needed to generate steam and 6 g/min remains as water. This results in a water/steam ratio of 1:5. Line C corresponds to a water flow/power ratio of 1:20. For example, if the power is 1350 W and the water flow is 67.5 g/min, 30 g/min is needed to generate steam and 37.5 g/min remains as water. This results in a water/steam ratio of 1:0.8. The area between the lines B and C indicates the area in which the water flow and the power can be selected to obtain the desired wetness of the steam in the steam generator and thus the desired mist steam at the atomizing device.

The invention claimed is:

1. A steam ironing device comprising a steam iron having a housing, a heatable soleplate at a bottom side of said housing, and at least one atomization device, said ironing device comprising a water supply device, a steam generator for generating steam, heating means for heating the steam generator, a flow path between the steam generator and the atomizing device, a valve provided in the flow path between the steam generator and the atomizing device, and an electric pump for delivering water from said water supply device to said steam generator, wherein the ironing device comprises control means for controlling a power of the heating means of the steam generator, for controlling a flow rate of the pump, and for controlling opening and closing of said valve, said valve being controlled to be open if a ratio between the flow rate (g/min) of the pump and the power (W) of the heating means is in a range of 1:20 to 1:38 to control wetness of steam delivered by the atomizing device otherwise said valve is controlled to be closed.

2. The ironing device of claim 1, wherein the ratio between the flow rate (g/min) of the pump and the power (W) of the heating means is controlled to be open in a range of 1:23 to 1:30 otherwise said valve is controlled to be closed.

3. The ironing device of claim 1, wherein said atomizing device comprises at least one nozzle provided in a front part of the housing.

4. The ironing device of claim 1, wherein said atomizing device comprises at least one nozzle provided in a tip area of the soleplate.

5. The ironing device of claim 1, wherein the soleplate is provided with at least one discharge opening which is connected to the steam generator through a second flow path in which a steam chamber is provided.

6. The ironing device of claim 1, wherein the soleplate is provided with at least one discharge opening which is connected to the steam generator through a second flow path between said valve and said at least one discharge opening, said valve opening the second flow path if the ratio between the flow rate of the pump and the power of the heating means is greater than 1:45 to control wetness of steam delivered by the at least one discharge opening.

7. The ironing device of claim 1, wherein the soleplate is provided with at least one discharge opening which is connected to the steam generator through a second flow path in which a second valve is provided, said second valve being controlled to be open if the ratio between the flow rate of the pump and the power of the heating means is greater than 1:45 to control wetness of steam delivered by the at least one discharge opening.

8. The ironing device of claim 6, wherein said iron comprises a steam chamber in said second flow path.

* * * * *